United States Patent [19]

Lockhart

[11] 4,277,089

[45] Jul. 7, 1981

[54] PHARMACEUTICAL RECORD AND LABEL SYSTEM

[76] Inventor: James L. Lockhart, 1645 E. 50th St., Chicago,, Ill. 60615

[21] Appl. No.: 7,217

[22] Filed: Jan. 29, 1979

Related U.S. Application Data

[63] Continuation-in-part of Ser. No. 831,818, Sep. 9, 1977, Pat. No. 4,159,129.

[51] Int. Cl.[3] ..... G09F 3/10; B41L 1/32; B41L 1/36

[52] U.S. Cl. ..... 282/27 R; 283/6; 283/1 A; 283/18; 283/21

[58] Field of Search ..... 282/29 A, DIG. 1, 27 R; 283/6, 9, 18, 57, 58, 59, 21, 1 R, 1 A, 1 B; 156/277; 40/18, 20, 2.2, 2 R

[56] References Cited

U.S. PATENT DOCUMENTS

| | | | |
|---|---|---|---|
| 2,520,077 | 8/1950 | Wolowitz | 283/9 R X |
| 4,021,060 | 5/1977 | Seeley et al. | 156/277 X |
| 4,029,341 | 6/1977 | Neill et al. | 282/28 R X |
| 4,068,028 | 1/1978 | Samonides | 156/277 X |
| 4,159,471 | 6/1979 | Whitaker | 283/1 R X |
| 4,190,268 | 2/1980 | Webster | 283/6 X |

*Primary Examiner*—Paul A. Bell

*Attorney, Agent, or Firm*—Hill, Van Santen, Steadman, Chiara & Simpson

[57] ABSTRACT

In one illustrated embodiment, a backing sheet capable of storing information relative to pharmaceutical prescriptions has a first series of adhesively backed pharmaceutical prescription label segments removably secured thereto, each label segment having formatted zones thereon for facilitating entry of typed information and accommodating simultaneous transfer of typewriter impressions to the backing sheet. A second series of supplemental data segments on the backing sheet provide for recording of supplementary information with respect to each label segment contemporaneously with the typing of the label segment. After removal of a prescription label segment from the backing sheet, the backing sheet has stored thereon both the formatted information as entered on the label segment and necessary supplemental data so as to facilitate computerized pharmaceutical accounting. In other embodiments a special transfer arrangement is provided for assuring reliable machine reading of the typewritten information.

1 Claim, 13 Drawing Figures

FIG. 6
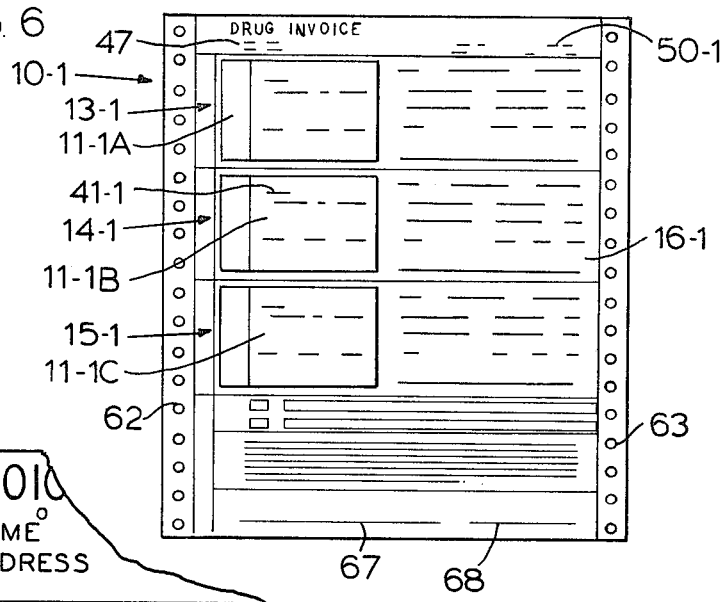
FIG. 7
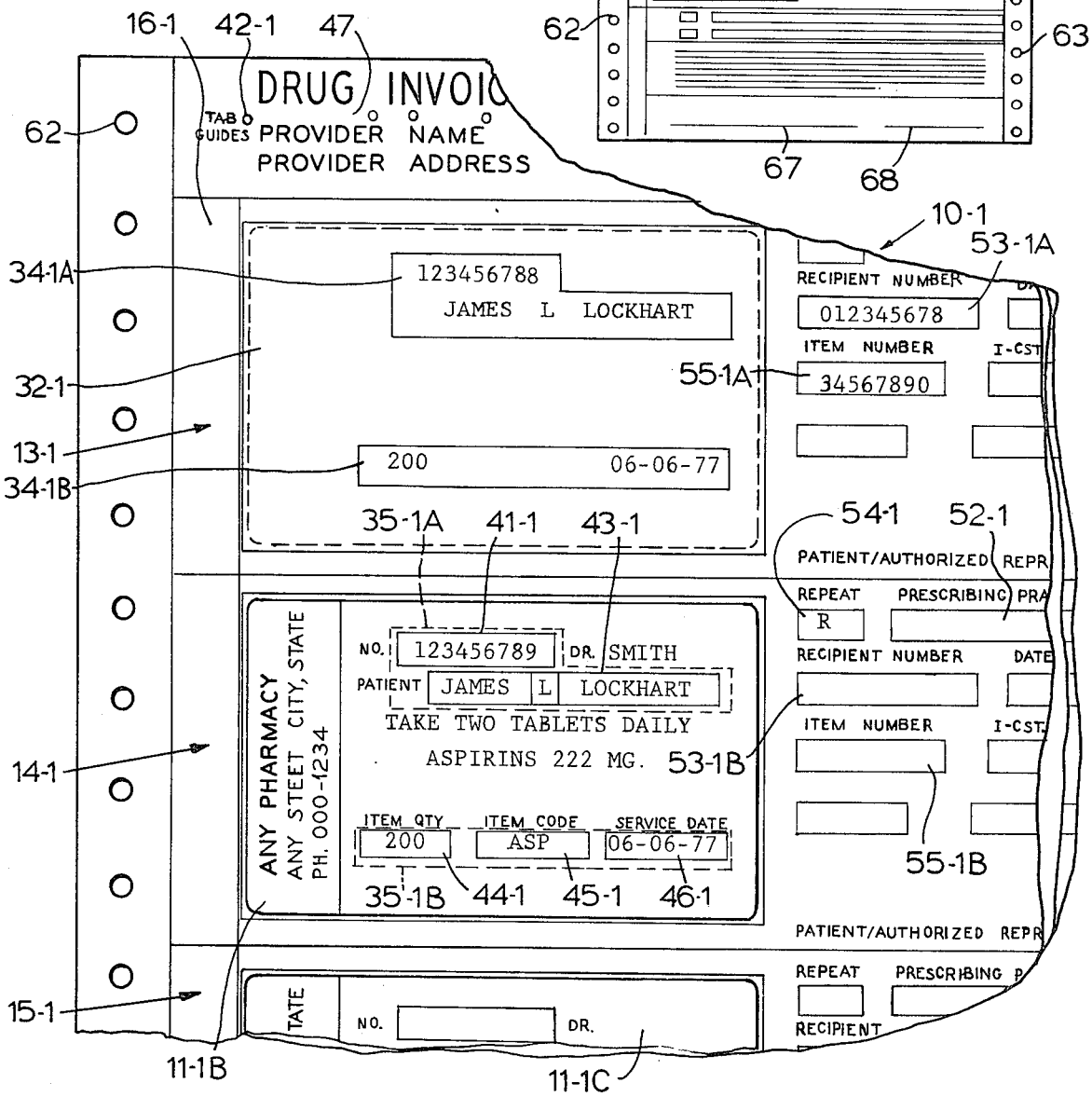
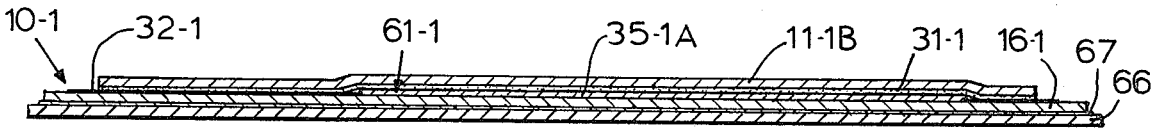
FIG. 8

PHARMACEUTICAL RECORD AND LABEL SYSTEM

CROSS REFERENCE TO RELATED APPLICATION

The present application is a continuation in part of my pending allowed application U.S. Ser. No. 831,818 filed Sept. 9, 1977, and now U.S. Pat. No. 4,159,129 and the disclosure and drawings of this application are incorporated herein by reference.

BACKGROUND OF THE INVENTION

In the field of pharmaceutical accounting, a number of the States have established a specialized format for accounting of prescriptions filled for public aid recipients. For example, the State of Illinois Department of Public Aid has established a new invoice form DPA 215 (R-6-76) which presents a substantial problem to small pharmacies seeking to be of service in this field. The filling out of such forms by means of a manually operated typewriter requires such a high degree of skill and accuracy as to present a serious obstacle to the individual pharmacy.

SUMMARY OF THE INVENTION

It is a particular object of the present invention to provide a record and label system for computerized pharmaceutical accounting which is sufficiently adaptable to enable its practical use by individual pharmacies as an integral part of the process of filling prescriptions.

A particular feature of the system resides in the provision of a record and label system wherein the act of preparing a formatted prescription label simultaneously provides hard copy data necessary to computerized accounting, a backing sheet which accumulates the label information having supplemental data segments for recording of supplementary information with respect to each label adjacent the space on the backing sheet storing character impressions with reference to the label segment, whereby after entry of information on the prescription label segments and removal thereof from the backing sheet, the backing sheet has stored thereon at each of a succession of unified identifiable regions of the backing sheet both formatted information as entered on the label segment and necessary supplemental data pertaining to a given prescription. The resultant backing sheet then contains a hard copy of the data required for computerization of the accounting process and being in a form suitable for delivery to a central computing station or the like under the varied circumstances of individual pharmacies. The system has actually been put into practice with a number of individual pharmacies and has successfully enabled the submission of the complex forms to the State within remarkably short time intervals after completion of the transactions in question.

Other objects, features and advantages of the present invention will be apparent from the following detailed description taken in connection with the accompanying sheets of drawings.

BRIEF DESCRIPTION OF THE DRAWINGS

FIG. 6 shows a second embodiment of the invention by means of a diagrammatic plan view.

FIG. 7 is a partial enlarged view of the embodiment of FIG. 6, but with a first prescription label removed and applied to a bottle as in FIG. 5.

FIG. 8 is a partial enlarged transverse sectional view of the form of FIG. 7 and taken through a portion of the form having a prescription label applied thereto.

DETAILED DESCRIPTION OF A PREFERRED EMBODIMENT

Figure 1:
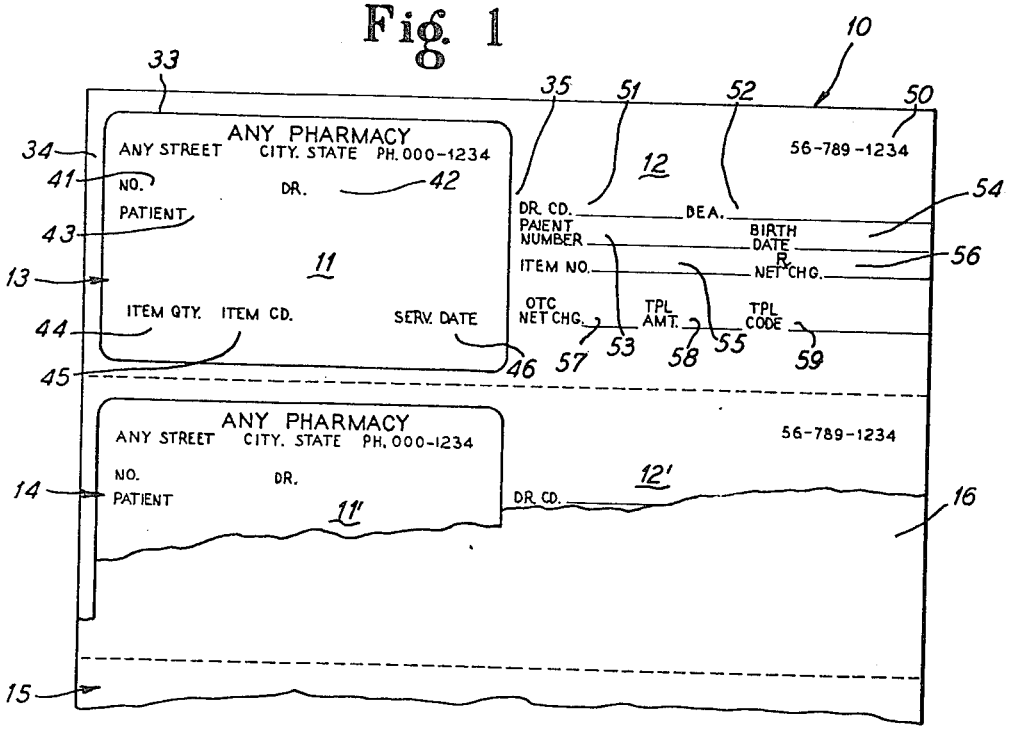
FIG. 1 illustrates a partial plan view of a record and label assembly in accordance with the present invention prior to entry of information with respect to individual pharmaceutical prescriptions.

In the illustrated embodiment, a record and label assembly 10 includes a pharmaceutical prescription label segment such as 11 and a supplemental data segment such as 12 at each of a series of unified data locations such as 13, FIG. 1, on a backing sheet 16. By way of preferred example, a convenient number of data locations such as three locations 13, 14 and 15 may be disposed on respective normally flat data sections such as indicated at 18 in FIG. 2, the successive sections 18 being joined together at successive pre-creased fold lines such as indicated at 19 and 20, so that the assembly 10 is adapted to lie flat in an accordion fold relation for handling and shipping. Prior to the development of this flat folded construction of the record and label assembly, the assembly was handled in the form of a roll as diagrammatically indicated at 10'. A typewriter such as indicated at 22 may suitably be provided with a bin configuration 23 for retaining the folded assembly 10 and also be provided with a reel type mounting including a side support 24 and a spindle 25 for mounting a roll configuration such as 10'. Thus, with the provision of means such as indicated at 23–25, typewriter 22 can receive either the preferred flat folding assembly 10 or the roll assembly 10' where it might be desired to accommodate both forms of record assembly. The assembly 10 at its leading edge 26 may be led back over the spindle 25 when the flat folded form is utilized so as to provide clearance between the incoming data sections and the data sections which have already received typed data with respect to individual pharmaceutical prescriptions.

Figure 3:
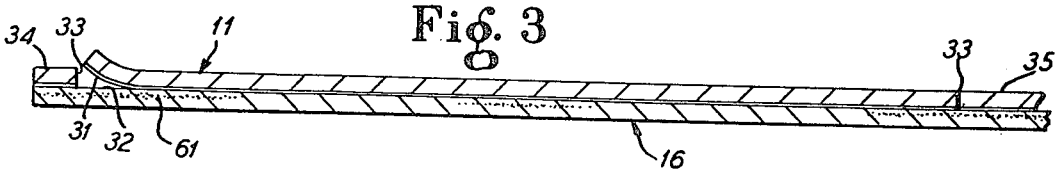
FIG. 3 is a somewhat diagrammatic transverse sectional view of the assembly of FIG. 1 and illustrating the step of removing a pharmaceutical prescription label segment from the backing sheet of the assembly after typed entry of the data with respect to such prescription.
Figure 4:
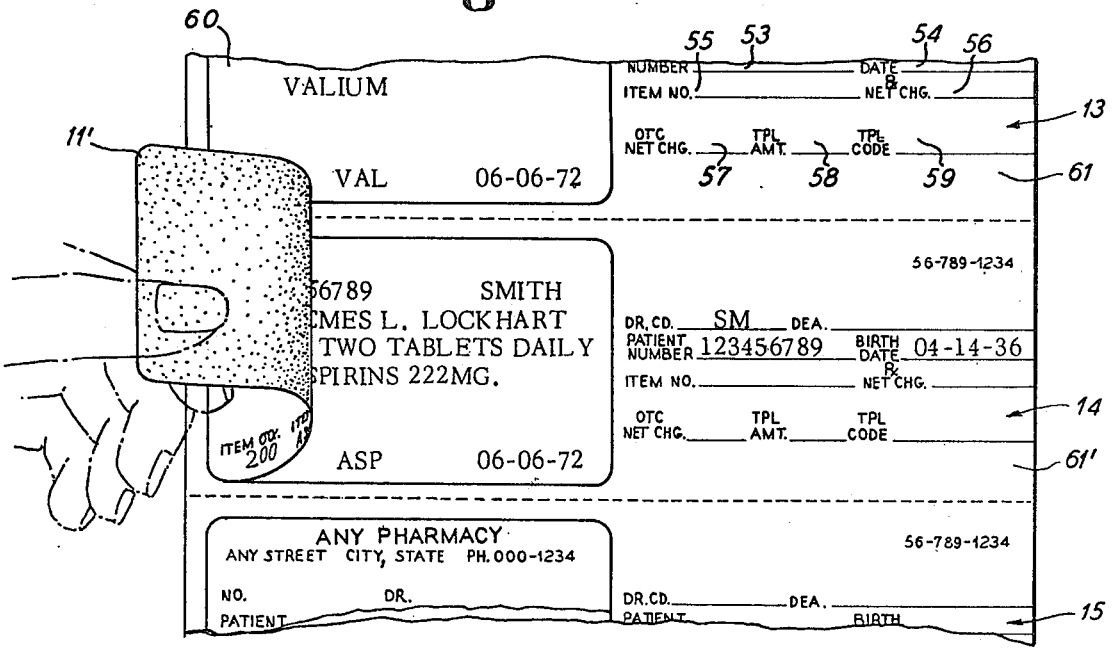
FIG. 4 is a somewhat diagrammatic partial plan view similar to FIG. 1 but illustrating a backing sheet of the assembly of FIGS. 1–3 after entry of data with respect to at least two successive pharmaceutical prescriptions, the figure showing a prescription label segment in the process of being removed from the backing sheet with respect to a central area of FIG. 4.

In the illustrated embodiment, each of the label segments such as 11 and 11' in FIG. 1 and such as indicated at 11' and 11'' in FIG. 4 is provided with a permanent adhesive backing such as indicated at 31 in FIG. 3, such backing being readily stripped from an interface surface 32 of backing sheet 16. Each of the label segments such as 11 and 11' in FIG. 1 is separate and severable from the assembly 10 by virtue of a pre-formed severance gap such as indicated at 33 which laterally separates each label segment from adjoining portions such as 34 and 35, FIG. 3, of the assembly 10. In a relatively high quality assembly 10, portions 34 and 35 are of the same material as the label segments such as 11 and have the same interface relation to the backing sheet 16 so that the assembly 10 as supplied to the individual pharmacy is of uniform thickness over its width and has a high quality typing surface which readily receives and retains typewritten data applied thereto by means of the manual typewriter 22.

As supplied to the individual pharmacy, the assembly 10 has a printed format thereon as shown in FIG. 1 providing for the typewritten entry of data at data regions 41–46 as follows: region 41, a prescription number which may be an eight digit decimal number; region 42, the name of the medical doctor issuing the prescription; region 43, the name of the patient; region 44, the quantity of the medication prescribed, with provision, for example, for a three-digit decimal number; region 45, an item code which may be any desired set of typed characters for identifying a given medication in the inventory of the individual pharmacy; region 46 providing for the entry of the service date. The item code can have provision for a four character code, each desired item having an established eight decimal digit item number which is required for the drug invoice form such as Illinois form DPA 215 (R-6-76) previously referred to.

By providing specifically arranged regions 41–46, and by providing an individual item code for the given pharmacy, a conventional size of label such as 11 can be utilized to simultaneously provide a maximum amount of information for the drug invoice without unduly burdening the individual pharmacy.

In the illustrated embodiment, the assembly 10 comprises a second series of supplemental data segments on the backing sheet 16 such as those indicated at 12 and 12', each supplemental data segment being laterally adjacent one of the label segments such as 11 and 11'. As illustrated, each assembly 10 is provided with a suitable code such as indicated at 50 which uniquely identifies the particular pharmacy for which such assembly is prepared. The code at region 50 thus enables the interpretation of the item code given at region 45 of the label segment so as to uniquely identify each eight digit item number as it must be presented on the drug invoice for purposes of pharmaceutical accounting. Each supplemental data segment such as that at 12 is further provided with formatted regions as indicated at 51–59, the regions 51 and 52 being in exact alignment with regions 41 and 42 of the associated label segment so as to be typed all on a common line by means of a typewriter such as indicated at 22. Similarly, regions 53 and 54 are on a common line with region 43 of the associated label segment, regions 51, 52; 53, 54; and 55, 56 having a spacing equal to the conventional line spacing of manual typewriters such as 22, so that once the typewriter is properly aligned with a given region such as 41, the automatic indexing of the typewriter will provide for proper entry of data at successive regions such as 51–59 as well as regions such as 42–46 of the label segment.

The significance of the regions 51–59 in the illustrated embodiment is as follows: region 51, a doctor identification code specific to the individual pharmacy, and keyed to an official nine character identification for prescribing practitioner; region 52, a space for the nine character official identification of prescribing practitioner, should a code for such practitioner not be established for the particular pharmacy represented by the identification at region 50, region 52 in conjunction with region 51 thus providing for the automatic entry of new practitioners into the list for the particular individual pharmacy; region 53 provides space for the official nine digit recipient identification number required by the drug invoice; region 54 providing further identification of the patient in the form of the data of birth of the patient; region 55 providing for entry of the official eight digit item number should no item code have been established with reference to region 45 of the associated label segment; region 56 providing space for entry of the net charge for the prescription; region 57 providing for entry of net charge in the case of an over-the-counter item; region 58 and region 59 refer to third party liability amount, and code identifying a copayer.

The item code in region 45 may be keyed to the current unit retail price of the medication so that this information along with item quantity can be used to automatically compute the net charge on the DPA 215 invoice.

As indicated at data field 60 in FIG. 4, at the time that a label such as 11 is typed, the imprinted characters are simultaneously transferred to the backing sheet 16 by virtue of the structure of the backing sheet 16 beneath label segments such as 11, the labels being sufficiently thin and pliable to accommodate such transfer. For example, backing sheet 16 particularly at the surface thereof underlying label segments such as 11 may be provided with encapsulated ink particles as indicated at 61 in FIG. 3 whereby ink particles are freed and become visible in the pattern of character impressions applied by typewriter 22 to the label segment such as 11. Thus the typewritten characters are transferred to the region 60 of backing sheet 16 simultaneously with the typewritten entry of the data on the label segments such as 11. After removal of the label segments such as 11, the backing sheet has stored thereon at a unified identifiable data location such as 13, 14 or 15 in FIG. 4 both formatted information as entered on the label segment and necessary supplementary data pertaining to a given prescription as entered at regions 51–59, FIG. 1, a supplementary data field 61 including regions 55–59 appearing in FIG. 4 together with associated data relevant to the prescription of data field 60.

Figure 5:
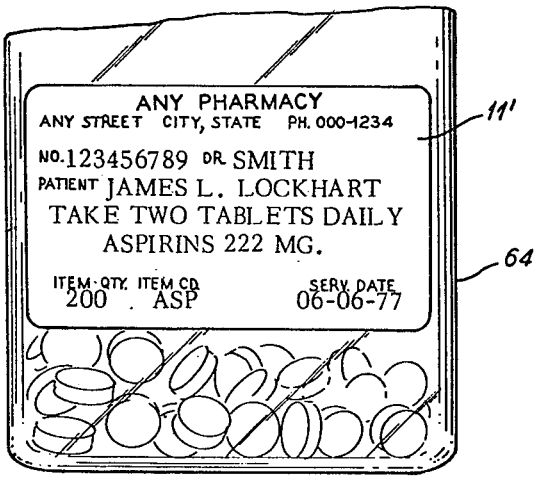
FIG. 5 is a partial diagrammatic view illustrating the application of the label segment removed in FIG. 4 to a container for the medication specified by the subject prescription.

FIG. 4 also shows label segment 11' being removed from the backing sheet 16 to leave the corresponding data field 60' with its associated supplementary data field 61' forming the further unified data location 14. FIG. 5 shows the label 11' of FIG. 4 applied to a container 64 which is to contain the medication of subject prescription. Thus the necessary data for computerization is generated simultaneously with the production of the identifying label for the container 64 with a minimum of further effort and expenditure of time. Further, because all of the necessary data for the drug invoice is accumulated at one time and simultaneously with the generation of the prescription label, the chances of error are minimized. By pre-storing the required eight digit item numbers and nine character prescribing practitioner identifications with respect to each individual pharmacy (as identified at 50 in FIG. 1), a computer system can accurately enter these numbers on the required drug invoice form with greatly reduced chances of error. For example, the doctor code entered on each prescription label segment may take the form of the doctor's initials in many cases, greatly simplifying and speeding the work at the individual pharmacy, while vastly reducing the overall chance of error. The item codes for the individual pharmacies may utilize mnemonic devices of a similar nature to speed entry of the base data and minimize the possibility of errors.

In a minimum record assembly, the backing sheet 16 may itself provide the supplementary data segments which directly receive the typewriter impressions. Where the backing sheet is of relatively thin low cost construction, the roll configuration 10' would be the usual form for storage and transport.

Embodiment of FIGS. 6, 7 and 8

FIG. 6 shows a second embodiment of the invention by means of a diagrammatic plan view.

FIG. 7 is a partial enlarged view of the embodiment of FIG. 6, but with a first prescription label removed and applied to a bottle as in FIG. 5.

FIG. 8 is a partial enlarged transverse sectional view of the form of FIG. 7 and taken through a portion of the form having a prescription label applied thereto.

The embodiment of FIGS. 6, 7 and 8 is directed to an improvement relative to the preceding embodiment particularly in assuring reliable and accurate machine readability of the backing sheet 16-1 after removal of the labels designated 11-1A, 11-1B and 11-1C from the form assembly designated 10-1.

Figure 2:
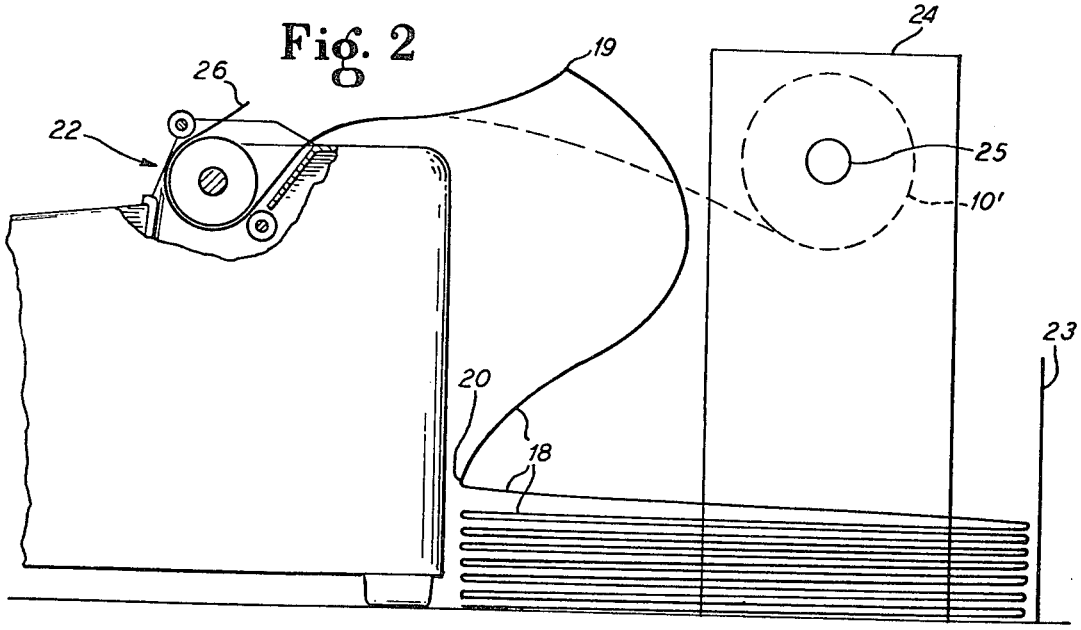
FIG. 2 is a somewhat diagrammatic partial elevational view illustrating the record and label assembly of FIG. 1 being fed into a manually operated typewriter for entry of data with respect to individual pharmaceutical prescriptions.

In conformance with the embodiment of FIGS. 1 and 2, a convenient number of data locations such as three locations 13-1, 14-1 and 15-1 may be disposed on respective normally flat data sections such as indicated at 18 in FIG. 2, the successive sections being joined together at successive pre-creased fold lines such as indicated at 19 and 20 in FIG. 2.

Each of the label segments such as 11-1B, FIGS. 7 and 8, is provided with a permanent adhesive backing such as indicated at 31-1 in FIG. 8, such backing being readily stripped from an interface surface 32-1 of the backing sheet 16-1. Each of the label segments is separate and severable from the assembly 10-1 by virtue of the relation of the label edges to the interface surface 32-1 as indicated in FIG. 8.

For assuring transfer of typewriter impressions applied to the labels to the backing sheet 16-1 at the regions such as 34-1A and 34-1B in machine readable form, machine reading transfer means are provided as specifically designated by reference numerals 35-1A and 35-1B in FIG. 7 and as generally designated at 61-1 in FIG. 8 and as specifically designated for example 35-1A in FIG. 8. The machine reading transfer strips 61-1 directly engage the machine readable surface of backing sheet 16-1 at the regions 34-1A and 34-1B and directly engage the adhesive layer such as 31-1 of the associated label.

The printed format on the labels generally conforms with that indicated in FIG. 1, but each label also includes formatting means such as boxes 41-1, 43-1, 44-1, 45-1 and 46-1 which are precisely located in relation to tab guide means 42-1 so as to ensure that the impressions transferred to the regions 34-1A and 34-1B of each data location will be precisely located in relation to the tab guides for accurate and reliable machine reading of the transferred impressions in these areas.

As indicated at 50-1 in FIG. 6, each assembly 10-1 may be provided with a suitable code such as one corresponding to the code 50 of FIG. 1 which uniquely identifies the particular pharmacy for which such assembly is prepared. On the other hand, the indicia indicated at 47 in FIG. 7 may be precisely located and printed relative to tab guides such as 42-1 so as to be machine readable and thus to provide the desired code identification corresponding to code 50 of FIG. 1. Thus, if desired, the machine readable sections such as 34-1A can include the space for the doctor's name, so that the doctor's name will also be machine readable and translatable into a doctor code in conformity with the previous embodiment. Similarly, an item code may be located as indicated at 34-1B in comparison with 45-1, in which case the item number would not need to be typed at location 55-1B, while where the code is omitted as indicated at 34-1B, the item number would be entered in the formatting location 55-1A. In the same way, since the patient name is machine readable at location 34-1A along with the identification code such as 50-1, it would not be necessary to enter the recipient number at a space such as 53-1 in FIG. 7 where the patient had already been identified in the processing system for the particular individual pharmacy identified for example at 50-1.

With a machine readable repeat symbol R, for example, at a machine reading zone 54-1, for example, any data not entered with respect to the second data location 14-1 would be assumed by the processing system to correspond to the data entered at data location 13-1.

Except as otherwise indicated the embodiment of FIGS. 6, 7 and 8 may have features corresponding to the preceding embodiment. Thus, the various machine readable guide lines which define regions such as 41-1, 43-1, 44-1, 45-1, 46-1, 53-1A, 53-1B, 54-1 and 55-1B may have a spacing equal to the conventional line spacing of manual typewriters such as 22, FIG. 2, so that once the typewriter is properly aligned with a given region such as 41-1 or 54-1, the automatic indexing of the typewriter will provide for proper entry of data a successive regions, the data being precisely located in relation to the tabs such as 42-1 to thereafter provide for machine reading of the data entered by a typewriter.

The various lines, shading, and captions used to define machine reading locations may be printed with "blind" ink which is invisible to the optical character reading equipment.

The significance of the various machine readable data locations will be apparent from the description of the preceding embodiment. Generally, as explained in relation to the preceding embodiment, the data retained on the backing sheet 16-1 after removal of the labels may be sufficient to prepare the invoice form referred to under the heading Background of the Invention, either by virtue of the presence of an individual pharmacy identification code such as 50-1, or by virtue of entry of the complete required numbers at locations such as 52-1, 53-1A, and 55-1A.

The provision of indexing holes such as 62 and 63, FIG. 6, precisely positioned relative to the tab guides such as 42-1 facilitates the preprinting of any desired data for a given individual pharmacy, such as the data at 50-1, 47, and the successive prescription numbers such as indicated at 41-1.

Thus, the holes 62, 63 facilitate the further minimization of the amount of manual typing required to produce the information required for the previously mentioned invoice form.

Reference numeral 66, FIG. 8, may designate a further sheet with a suitable transfer medium 67 so that any typed information is simultaneously transferred to the further sheet 66, which may serve as a copy for the individual pharmacy, the form 10-1 being suitable for receiving a provider signature at 67 and a date 68 and other certification and the like so as to render the backing sheet 16-1 as wholly sufficient in itself for submission to the ultimate paying entity such as a State department of public aid in place of the invoice form previously mentioned. Such ultimate paying authority would then have the necessary optical character reading equipment, and the necessary data with respect to individual pharmacies so as to enable the usual processing operations but with the assistance of machine reading equipment.

It will be understood that with the embodiment of FIGS. 6, 7 and 8, the backing sheet 16-1 is a high quality bond paper suitable for use in conjunction with conventional optical character reading equipment. In one embodiment of the system of FIGS. 1–5, the backing sheet 16 was of relatively thin low cost construction and preprinted with the designations shown at 12 and 12' in FIG. 1 so as to directly receive the typewriter impressions. The embodiment of FIGS. 6, 7 and 8 is similar to this modification of FIGS. 1–5 in its basic structure, but with modifications as just described so as to ensure accurate and reliable machine reading of the typed data which is required by the automatic processing system of the intended recipient. The backing sheet 16 of FIGS. 1–5, and the further sheet 66 of FIG. 8, in a minimum record assembly, may each be of relatively thin low cost construction, without any preprinting or other indicia except as are produced by the automatic computer entry of items such as indicated at 47 and 41-1, and except as thereafter produced by the typewritten entries made during the course of filling individual prescriptions.

In each of the embodiments the form assembly 10-1, 10-2, 10-3, 10-4 or 10-5 can be submitted by the individual pharmacy to a computer processing service where the data for interpreting the codes of each individual pharmacy can be available in the system. Such service would then machine read the submitted source documents such as 16-1 or 70 and automatically prepare the required receiving medium, for example the Illinois invoice form DPA 215 (R-6-76) required by the third party payer.

Figure 9:
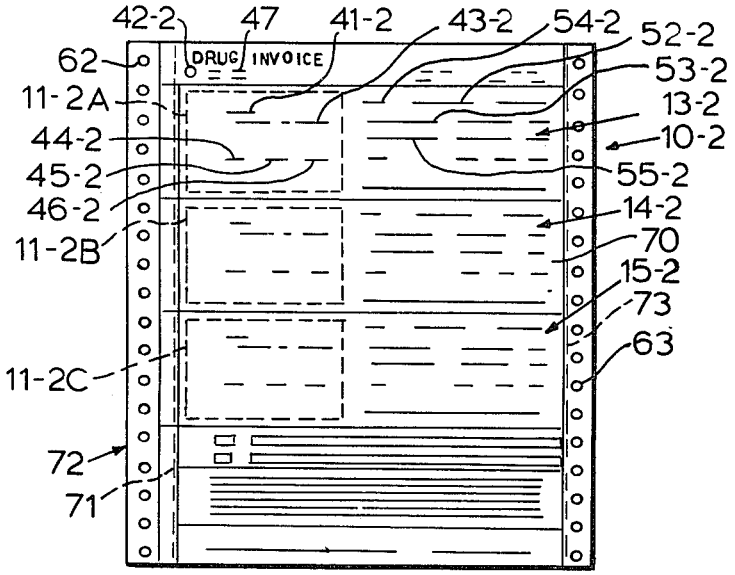
FIG. 9 is a somewhat diagrammatic plan view similar to FIG. 6, but showing a further embodiment of the invention particularly suited for processing with the use of optical character reading equipment.
Figure 10:
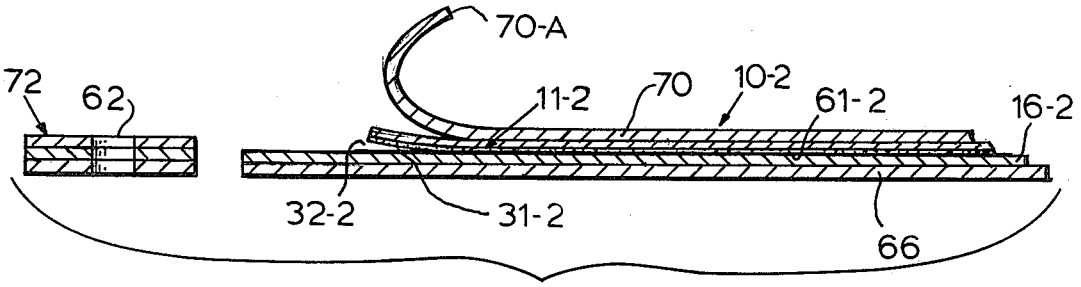
FIG. 10 is a somewhat diagrammatic transverse sectional view similar to FIG. 8 of the preceding embodiment.

Embodiment of FIGS. 9 and 10

FIG. 9 is a somewhat diagrammatic plan view similar to FIG. 6, but showing a further embodiment of the invention particularly suited for processing with the use of optical character reading equipment.

FIG. 10 is a somewhat diagrammatic transverse sectional view similar to FIG. 8 of the preceding embodiment.

The form 10-2 has characteristics similar to the form 10-1 of FIG. 6 including the provision of tab guides such as indicated at 42-2, and accurately located label segment formatting means, for example in the form of blocks or open rectangles at locations such as 41-2, 43-2, 44-2, 45-2 and 46-2 and at 52-2, 53-2, 54-2 and 55-2 for each of the data segments such as 13-2, 14-2 and 15-2. Again the sprocket holes such as 62 and 63 can facilitate the accurate automatic machine entry of information for example at location 47 and if desired at location 41-2 in accurate relation to the tab guides such as 42-2.

In the embodiment of FIGS. 9 and 10, the backing sheet is indicated at 16-2 and may have a surface 61-2 with characteristics so as to respond to typed impressions to render the impressed characters visible on the backing sheet, such paper being well known in the art. The label 11-2 has its adhesive layer 31-2 adhered to an interface 32-2 including a suitable release agent so as to facilitate separation of label 11-2 with its adhesive intact from the backing sheet 16-2. A further sheet 66 may correspond to the further sheet 66 of FIG. 8.

The form assembly 10-2 further includes a top sheet 70 which overlies the labels 11-2 and which are specifically designated 11-2A, 11-2B and 11-2C in FIG. 9. Thus, the machine reading locating means for defining the entry of the typed information such as 41-2, 43-2, 44-2, 45-2, 46-2, 52-2, 53-2, 54-2 and 55-2 are all preprinted on the top sheet 70, for example in "blind" ink, and the top sheet 70 is of high quality bond material suitable for use with optical character reading equipment. In this embodiment, all of the typed data is originally impressed directly on the upper surface of the top sheet 70, and no transfer means such as indicated specifically at 35-1A and 35-1B in FIG. 7 are required for producing the desired quality of character registration.

As indicated in FIG. 9, form 10-2 may have a perforation as indicated at 71 which enables a margin portion 72 of the form assembly 10-2 to be severed, whereupon edge 70A of the top sheet 70 can be curled back as indicated in FIG. 10 to expose the edge of label 11-2 for removal from the interface 32-2. As is understood in the art, prior to severance of the form at line 71, the perforations at 71 may serve to maintain all parts or laminations of the form assembly 10-2 in secure relationship to each other. A similar severance perforation line may be provided at 73, but this is not required to provide access to the labels such as indicated at 11-2 in FIG. 10.

With the embodiment of FIGS. 9 and 10, the labels such as 11-2 may have upper surfaces sensitive to type impression to render the typed characters visible on the surface of the label, so that the data entered at the left hand side of each data segment such as 13-2 is automatically transferred to the surface of the labels, so that the labels, such as 11-2 may be utilized in the same way as indicated in FIG. 5. Labels with this type of impression responsive surface are known per se.

Where the individual pharmacy is equipped with an on-line computer printer, each embodiment may be provided with feed holes such as 62, 63, and the terminal can automatically print out all required identifying data on the label such as 11, 11-1B, FIG. 8, 11-2A, etc., and on the top sheet surface such as 35, FIG. 3, 16-1, FIG. 8, or 70, such identifying data being indicated for example at 41-1, 43-1, 44-1, 45-1, 46-1, 53-1A and 55-1A, FIG. 7. Where the terminal operator enters a code or abbreviated instruction, the computer can interpret the same and print out the complete label and supplementary information on the form as well as storing the information in the desired form.

Figure 10A:
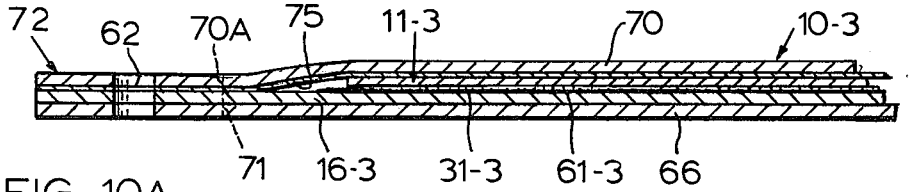
FIGS. 10A, 10B and 10C are views similar to FIG. 10 but showing respective modifications thereof.

Embodiment of FIG. 10A

FIG. 10A is a view similar to FIG. 10, and wherein corresponding reference numerals have been applied to corresponding parts to avoid repetitious description. In the embodiment of FIG. 10A, in place of the impression responsive surface of the label 11-2, the label 11-3 is of suitable material for receiving impressions by means of carbon paper 75 which is interposed between the machine readable type bond paper 70 and the label 11-3 and adjoining portions of the backing sheet 16-3 which underlie the regions corresponding to 13-2, 14-2, and 15-2 in FIG. 9.

Figure 10B:
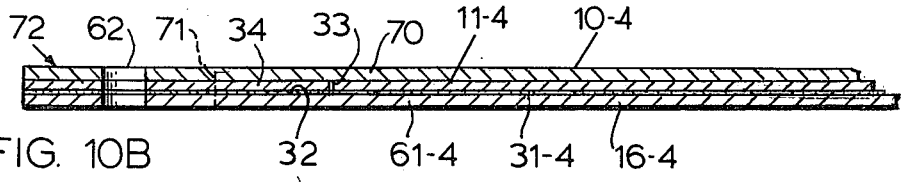

Embodiment of FIG. 10B

FIG. 10B is a view similar to FIGS. 10 and 10A, and illustrates a case where the bond top sheet 70 is essentially laminated on top of the assembly of FIG. 3. Accordingly, corresponding reference numerals have been applied to parts in FIG. 10B which correspond to the parts of FIG. 3. The label 11-4, however, is modified in comparison to label 11 of FIG. 3, since the label 11-4 in this embodiment is to correspond in its impression responsive characteristics to the label 11-2 of FIGS. 9 and 10. Thus, as in the previous embodiments, the computer printed material such as indicated at 47 is impressed on the surface of top sheet 70 and is transferred by means of conventional carbonless transfer means to the underlying backing sheet 16 as well as to label 11-4 and the adjoining portions such as indicated at FIG. 1 and such as designated by reference numeral 35 in FIG. 3. The corresponding part in FIG. 10B which forms a continuation of the label 11-4 has the same carbonless transfer characteristics as the surface of the label 11-4 so as to register the typed impression applied to the top sheet 70 as in the previous embodiments.

Figure 10C:
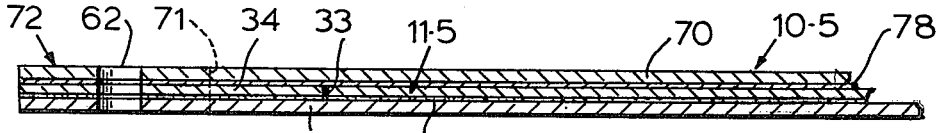

Embodiment of FIG. 10C

The embodiment of FIG. 10C is a partial transverse sectional view similar to FIG. 10B, but showing the case where a carbon sheet 78 is laminated with the OCR bond top sheet 70, the relatively high quality label sheet including label 11-5 and portions such as indicated at 34 and as indicated at 35 in FIG. 3, and a backing sheet 16-5 of the carbonless transfer type similar to the backing sheet indicated at 16 in FIG. 3, the sheet 16-5 for example being entirely free of preprinting, but receiving the computer impact printed information such as may be entered at 47 and receiving the manually typed information as typed on the surface of top sheet 70.

In each of the embodiments of FIGS. 9, 10, 10A, 10B and 10C, the end result is the same as for the embodiment of FIGS. 6, 7 and 8, namely the provision of a machine readable source document 70 with precisely arranged typed data so that all of the required information for example for the invoice form referred to under the heading Background of the Invention is available by machine reading of the information on the top sheet 70. Thus, the details described in relation to the embodiments of FIGS. 6, 7 and 8 are generally applicable to the further embodiments, the further embodiments having the characteristic that all of the data applied to the label segment formatting means (here formed by preprinted rectangles in "blind" ink on the top sheet 70) are directly applied to the sheet (70) which is to be transmitted to the form recipient for automatic processing with the use of optical character reading equipment. The embodiments of FIGS. 10B and 10C have the particular advantage that each lamination is of uniform thickness and coextensive with the other laminations as in the embodiment of FIG. 3. In each of the embodiments of FIG. 6 through FIG. 10C, the perforation lines such as indicated at 71 and 73 may serve to retain the various laminations of the respective forms in assembled relationship until a margin such as 72 is intentionally severed as indicated in FIG. 10.

It will be apparent that many modifications and variations may be effected without departing from the scope of the novel concepts and teachings of the present invention.

I claim as my invention:

1. A record and label system for computerized pharmaceutical accounting, comprising:

unitary information storage means comprising a top information storage sheet storing information in readable form as ink characters, relative to pharmaceutical prescriptions, transferred thereto by means of ink character impressions which apply the ink directly to said top information storage sheet, a series of adhesively backed pharmaceutical prescription label segments secured to said information storage means in underlying relation to said top information storage sheet, while permitting manual stripping of the label segments with adhesive backing intact from said information storage means, said label segments each having label information receiving locations thereon for receiving information concerning a pharmaceutical prescription, said top information storage sheet having formatted zones thereon corresponding in location to said label information receiving locations so as to be in direct alignment therewith, for facilitating entry of said ink character impressions directly to the portions of said top storage sheet overlying said label information receiving locations of said label segments, and having supplemental data segments providing for recording of supplementary information with respect to each formatted zone at a location adjacent the formatted zone, such that after entry of information on the top storage sheet, the top storage sheet has stored thereon at each of a succession of unified identifiable regions of the top storage sheet both formatted information as also required for a respective one of said label segments and necessary supplementary data pertaining to a given prescription, said information storage means having character impression transfer means interposed between said top storage sheet and said series of label segments with said top storage sheet overlying all of said pharmaceutical label segments such that ink character impressions applied to said top storage sheet are transferred to said label segments, said top storage sheet having means providing exterior machine readable surface portions at said formatted zones for retaining said ink characters in machine readable form which ink characters are at the same time in the form of visually readable conventional characters, said top storage sheet being of opaque paper stock with the identical information which is transferred to said label segments by means of said character impression transfer means, being present in said formatted zones of said top information storage sheet, and being readable by both optical character reading equipment and by personnel processing such top storage sheet.

* * * * *